US008978922B2

(12) United States Patent
Baker et al.

(10) Patent No.: US 8,978,922 B2
(45) **Date of Patent: *Mar. 17, 2015**

(54) STRENGTHENED FOOD CONTAINER AND METHOD

(75) Inventors: Gerald J. Baker, Wauwatosa, WI (US); Rowdy H. Holstine, Hartford, WI (US); Jianwen Hu, Nashotah, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 18 days.

This patent is subject to a terminal disclaimer.

(21) Appl. No.: 13/486,660

(22) Filed: Jun. 1, 2012

(65) Prior Publication Data

US 2013/0306661 A1 Nov. 21, 2013

Related U.S. Application Data

(60) Provisional application No. 61/647,144, filed on May 15, 2012.

(51) Int. Cl.

| | |
|---|---|
| ***B65D 8/12*** | (2006.01) |
| ***B21D 15/00*** | (2006.01) |
| ***B21D 39/20*** | (2006.01) |
| ***B21D 39/02*** | (2006.01) |
| ***B65D 8/04*** | (2006.01) |
| ***B21D 51/26*** | (2006.01) |

(Continued)

(52) U.S. Cl.

CPC ..... *B21D 15/06* (2013.01); *B21D 51/2607* (2013.01); *B65D 7/46* (2013.01); *Y10S 220/906* (2013.01)

USPC ..... 220/672; 220/906

(58) Field of Classification Search

CPC .... B21D 15/06; B21D 15/2607; B21D 51/12; B21D 51/2646; B65D 7/46; B65D 7/42; B65D 7/44

USPC ..... 220/672, 669, 670, 906, 667, DIG. 1; 29/454; D9/773, 774, 776; 215/382–384

See application file for complete search history.

(56) References Cited

U.S. PATENT DOCUMENTS

| | | | | |
|---|---|---|---|---|
| 1,643,252 | A * | 9/1927 | McCrery | 220/DIG. 1 |
| 1,649,292 | A * | 11/1927 | Draper | 220/672 |
| 2,063,013 | A | 12/1936 | Cooper | |

(Continued)

FOREIGN PATENT DOCUMENTS

| | | |
|---|---|---|
| JP | 62-3839 | 1/1987 |
| JP | 62-263836 | 11/1987 |

(Continued)

OTHER PUBLICATIONS

U.S. Appl. No. 29/419,768, filed May 1, 2012, Thomas Murphy.

(Continued)

*Primary Examiner* — Andrew Perreault

(74) *Attorney, Agent, or Firm* — Reinhart Boerner Van Deuren s.c.

(57) ABSTRACT

A metal food can including a metal sidewall is provided. The diameter of the sidewall varies at different axial positions along the sidewall. The can includes a can end coupled to an end of the metal sidewall, and a plurality of circumferential beads formed in the metal sidewall. The shape of each circumferential bead varies based upon the diameter of the section of the sidewall in which the beads are formed.

14 Claims, 11 Drawing Sheets

(51) Int. Cl.
*B21D 15/06* (2006.01)
*B65D 6/38* (2006.01)

(56) References Cited

U.S. PATENT DOCUMENTS

| | | | | | |
|---|---|---|---|---|---|
| 2,100,480 | A | | 11/1937 | Hirshman | |
| D112,800 | S | * | 1/1939 | Watson | D9/542 |
| 2,405,399 | A | | 8/1946 | Bugg et al. | |
| D201,400 | S | | 6/1965 | Kneeland | |
| 3,225,727 | A | | 12/1965 | Winton | |
| 3,268,109 | A | | 8/1966 | Coppens | |
| 3,459,028 | A | | 8/1969 | Bijvoet | |
| 3,698,337 | A | | 10/1972 | Brawner et al. | |
| 3,759,203 | A | | 9/1973 | Frankenberg | |
| 4,264,017 | A | * | 4/1981 | Karas et al. | 220/62.17 |
| 4,512,490 | A | | 4/1985 | Frei et al. | |
| 4,781,301 | A | * | 11/1988 | Le Bret et al. | 220/672 |
| 4,921,116 | A | | 5/1990 | Troughton et al. | |
| 5,022,254 | A | | 6/1991 | Kramer | |
| 5,040,946 | A | | 8/1991 | Caoduro | |
| D323,290 | S | | 1/1992 | Keedy, Jr. | |
| 5,397,021 | A | * | 3/1995 | Usui | 220/672 |
| 5,730,315 | A | * | 3/1998 | Richoux | 220/672 |
| D394,212 | S | * | 5/1998 | Mazda | D9/557 |
| 5,899,106 | A | | 5/1999 | Heurteboust et al. | |
| 5,938,389 | A | | 8/1999 | Shore et al. | |
| 6,012,601 | A | | 1/2000 | Van Dam | |
| D445,030 | S | | 7/2001 | Croft et al. | |
| D445,337 | S | | 7/2001 | Croft et al. | |
| 6,286,357 | B1 | | 9/2001 | D'Amore et al. | |
| 6,354,458 | B1 | | 3/2002 | Policappelli | |
| D536,262 | S | | 2/2007 | Ioannides et al. | |
| D536,263 | S | | 2/2007 | Ioannides et al. | |
| D536,264 | S | | 2/2007 | Ioannides et al. | |
| D543,845 | S | | 6/2007 | Ioannides et al. | |
| D548,111 | S | | 8/2007 | Ioannides et al. | |
| D549,596 | S | | 8/2007 | Ioannides et al. | |
| D559,120 | S | | 1/2008 | Farrow et al. | |
| D559,121 | S | | 1/2008 | Farrow et al. | |
| D588,018 | S | | 3/2009 | Metzger et al. | |
| D588,019 | S | | 3/2009 | Diss | |
| D588,020 | S | | 3/2009 | Van Scoyoc et al. | |
| D588,936 | S | | 3/2009 | Ioannides et al. | |
| D596,501 | S | | 7/2009 | Diss et al. | |
| D596,502 | S | | 7/2009 | Diss et al. | |
| D596,503 | S | | 7/2009 | Diss | |
| 7,584,639 | B2 | | 9/2009 | Boltshauser | |
| D611,838 | S | | 3/2010 | Metzger et al. | |
| D613,617 | S | | 4/2010 | Metzger et al. | |
| D614,049 | S | | 4/2010 | Diss et al. | |
| D614,508 | S | | 4/2010 | Hu | |
| D615,877 | S | | 5/2010 | Hu | |
| D619,022 | S | | 7/2010 | Diss | |
| D620,377 | S | | 7/2010 | Diss | |
| D626,015 | S | | 10/2010 | Diss et al. | |
| D631,759 | S | | 2/2011 | Diss et al. | |
| D632,187 | S | | 2/2011 | Diss et al. | |
| D632,189 | S | | 2/2011 | Diss et al. | |
| D638,311 | S | | 5/2011 | Diss | |
| D651,526 | S | | 1/2012 | Hu et al. | |
| D652,740 | S | | 1/2012 | Metzger et al. | |
| D652,741 | S | | 1/2012 | Van Scoyoc et al. | |
| D652,742 | S | | 1/2012 | Diss | |
| D653,123 | S | | 1/2012 | Ziegler | |
| D653,124 | S | | 1/2012 | Diss | |
| D653,125 | S | | 1/2012 | Murphy | |
| D653,126 | S | | 1/2012 | Murphy | |
| 8,141,741 | B2 | | 3/2012 | Metzger et al. | |
| D658,078 | S | | 4/2012 | Hu et al. | |
| 8,186,528 | B2 | * | 5/2012 | Melrose et al. | 220/669 |
| D661,203 | S | | 6/2012 | Murphy | |
| D661,204 | S | | 6/2012 | Murphy | |
| D663,210 | S | | 7/2012 | Diss et al. | |
| D663,622 | S | | 7/2012 | Diss et al. | |
| D672,663 | S | | 12/2012 | Baker et al. | |
| 2006/0108318 | A1 | * | 5/2006 | Chisholm | 215/382 |
| 2007/0045218 | A1 | | 3/2007 | Afandyan | |
| 2007/0090120 | A1 | | 4/2007 | Bezek | |
| 2008/0216538 | A1 | | 9/2008 | Kubacki et al. | |
| 2009/0212004 | A1 | | 8/2009 | Metzger et al. | |
| 2009/0218349 | A1 | | 9/2009 | Metzger et al. | |
| 2011/0272417 | A1 | | 11/2011 | Holstine et al. | |
| 2012/0145584 | A1 | | 6/2012 | Metzger et al. | |

FOREIGN PATENT DOCUMENTS

| | | |
|---|---|---|
| JP | 1-215420 | 8/1989 |
| JP | 07-089543 | 4/1995 |
| JP | 2011-224627 | 11/2011 |
| WO | WO 94/09926 | 5/1994 |

OTHER PUBLICATIONS

U.S. Appl. No. 29/423,572, filed Jun. 1, 2012, Baker et al.
Nestle—Nescau website at http://www.nestle.com.br/site/marcas/Nescau/aspx, dated Nov. 21, 2009, retrieved via web.archive.org at http://web.archive.org/web/20091121011900/http://www.nestle.com.br/site/marcas/Nescau.aspx 2 on Jul. 26, 2013, 2 pages.
Photograph of Nescau metal container, believed to be commercially available at least in Brazil, at least by 2007, 1 page.
Photograph of bottom end of Nescau metal container, believed to be commercially available at least in Brazil, at least by 2007, 1 page.
International Search Report and Written Opinion for International Application No. PCT/US2013/036803, mail date Jul. 11, 2013, 18 pages.

* cited by examiner

STRENGTHENED FOOD CONTAINER AND METHOD

CROSS-REFERENCE TO RELATED PATENT APPLICATION

This application claims the benefit of U.S. Provisional Patent Application No. 61/647,144 titled "STRENGTHENED FOOD CONTAINER AND METHOD," filed May 15, 2012, which is incorporated herein by reference in its entirety.

BACKGROUND OF THE INVENTION

The present invention relates generally to the field of containers. The present invention relates specifically to a metal food can having a non-cylindrical, strengthened sidewall.

SUMMARY OF THE INVENTION

One embodiment of the invention relates to a metal food can including a metal sidewall having an axial center point. The diameter of the sidewall varies at different axial positions along the sidewall. The can includes a can end coupled to an end of the metal sidewall, and a plurality of circumferential beads formed in the metal sidewall. The shape of each circumferential bead varies based upon the diameter of the section of the sidewall in which the beads are formed.

Another embodiment of the invention relates to a metal can for holding and storing food. The metal can includes a container end and a non-cylindrical metal sidewall. The metal sidewall includes a center section having a first diameter and an upper sidewall section located above the center section having a second diameter different than the first diameter. The upper sidewall section extends radially relative to the center section to provide the transition from the first diameter to the second diameter. The metal sidewall includes a lower sidewall section located below the center section having a third diameter different than the first diameter, and the lower sidewall section extends radially relative to the center section to provide the transition from the first diameter to the third diameter. The metal sidewall includes a plurality of circumferential beads formed in the metal sidewall each having a bead depth. At least one circumferential bead is formed in each of the center section, the upper sidewall section and the lower sidewall section.

Another embodiment of the invention relates to a method of forming a beaded metal food can. The method includes providing a cylindrical metal tube having an upper edge defining an upper opening and a lower edge defining a lower opening. The method includes forming a plurality of circumferential beads in the cylindrical metal tube. The method includes shaping the cylindrical metal tube to form a non-cylindrical metal sidewall, after forming the plurality of circumferential beads.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the figures, various embodiments of a strengthened food container are shown. Specifically, the embodiments relate to metal food cans having a non-cylindrical sidewall and strengthening beads formed in the sidewall. In various embodiments, the containers discussed herein are configured to contain foods at a negative internal pressure (e.g., cans that have an internal vacuum) and the negative internal pressure results in an inwardly directed force on the sidewall of the can. The beads act to provide strength to the sidewall, and the beaded sidewalls discussed herein are configured to provide support to a non-cylindrical metal sidewall, particularly against the inwardly directed force.

Figure 1A:
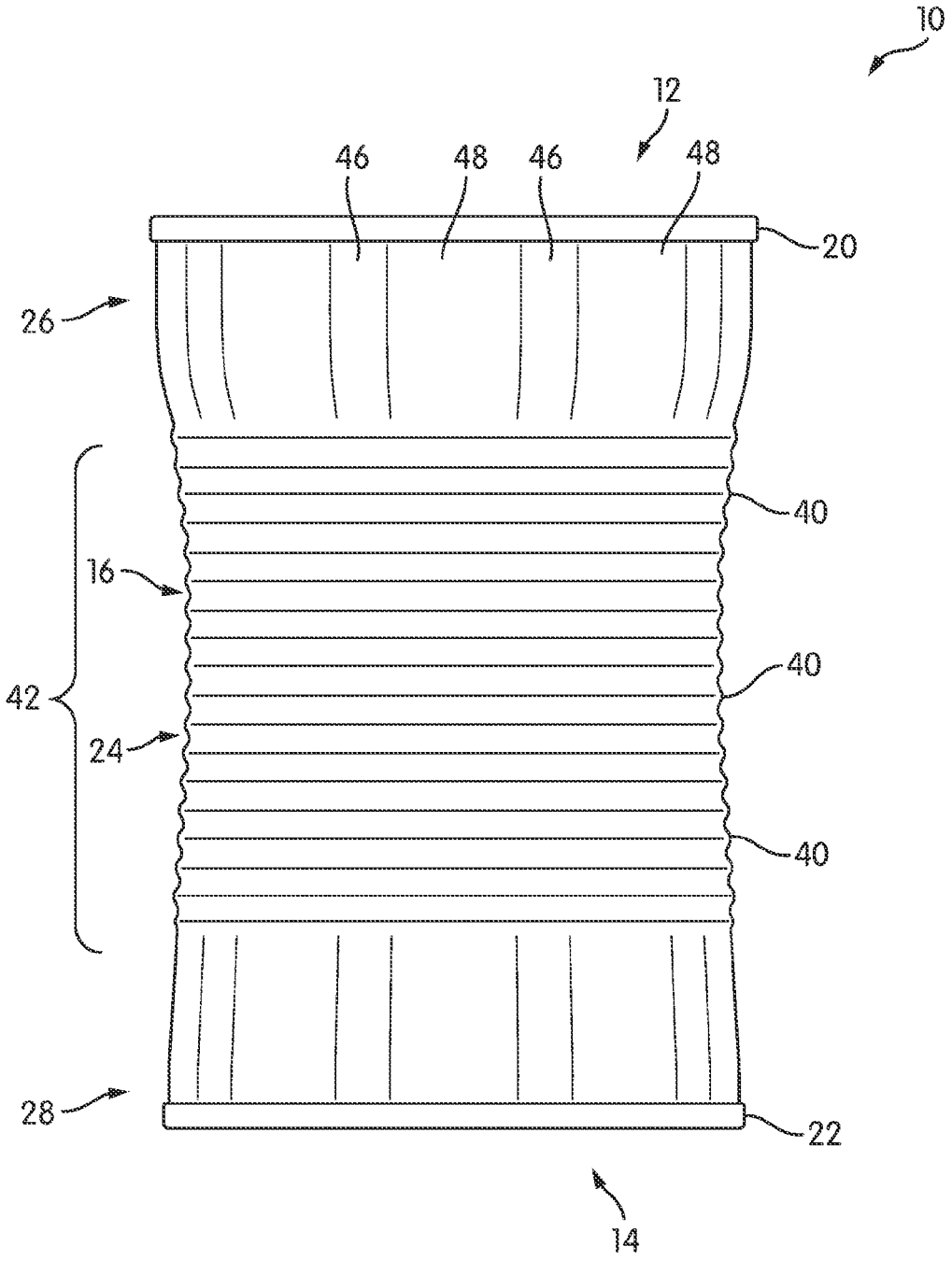
FIG. 1A is a front elevation view of a container, according to an exemplary embodiment.
Figure 1B:
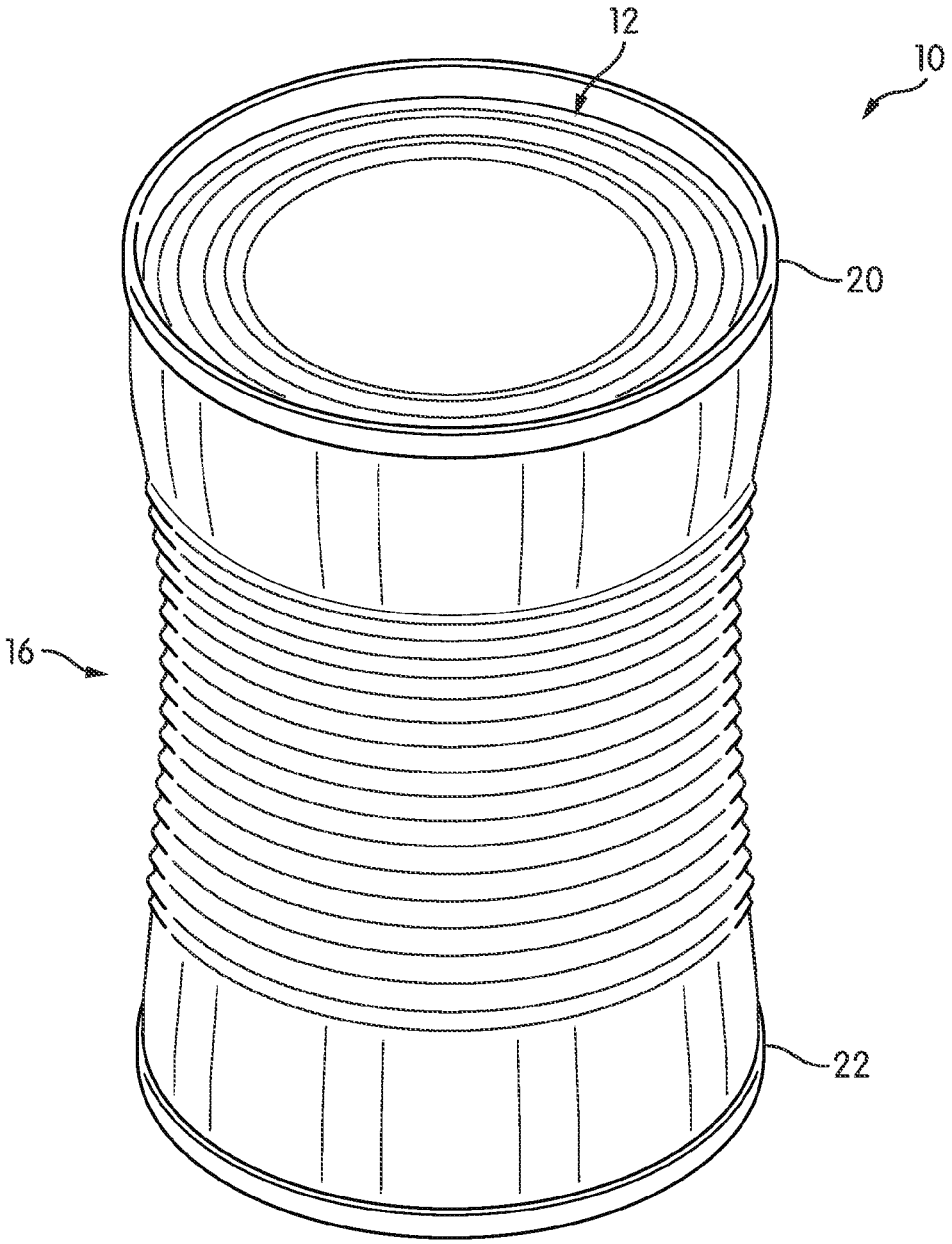
FIG. 1B is a top perspective view of the container of FIG. 1A, according to an exemplary embodiment.

Referring to FIG. 1A and FIG. 1B, a container, shown as metal food can 10, is shown according to an exemplary embodiment. Can 10 includes a first container end, shown as an upper end wall 12, and a second container end, shown as lower end wall 14. Can 10 also includes a sidewall 16. Generally, upper end wall 12 is coupled to an upper end of sidewall 16, and lower end wall 14 is coupled to a lower end of sidewall 16. As shown, upper end wall 12 and lower end wall 14 are can ends designed to be removed using a tool, such as a can opener.

Sidewall 16 is a metal sidewall and is coupled to upper end wall 12 and lower end wall 14 via hermetic seams. A first seam 20 joins upper end wall 12 to sidewall 16, and a second seam 22 joins lower end wall 14 to sidewall 16. In the embodiment shown, seams 20 and 22 are hermetic double seams (shown in detail in FIG. 8) formed of interlocked and crimped sections of the upper and lower edges of sidewall 16 and of the periphery of end walls 12 and 14, respectively.

Figure 2:
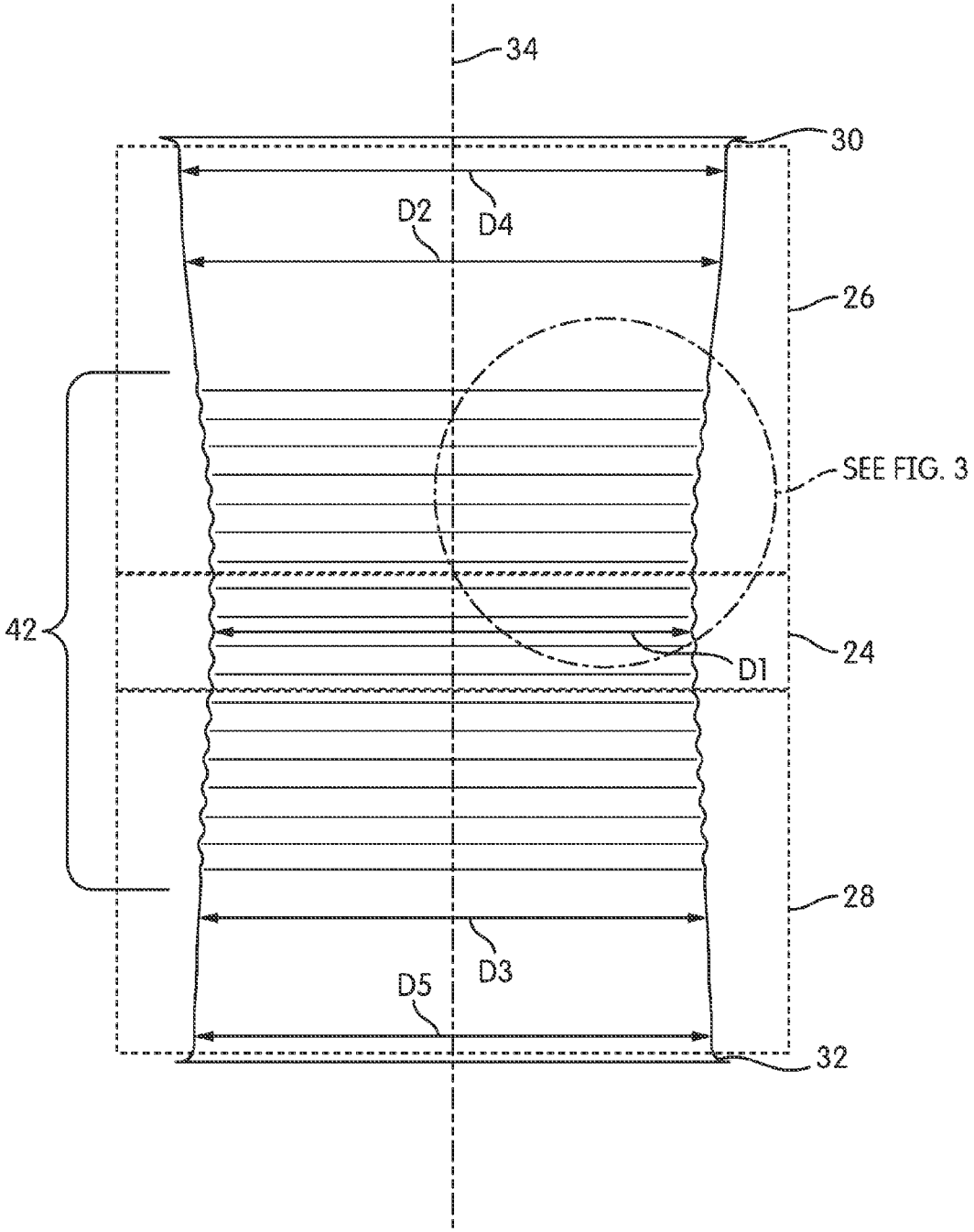
FIG. 2 is a sectional view along the longitudinal axis of the container of FIG. 1A, according to an exemplary embodiment.

Generally, sidewall 16 is a non-cylindrical sidewall (e.g., a sidewall in which the cross-sectional shape varies at different positions along the axial length of the sidewall, a sidewall in which the cross-sectional area varies at different positions along the axial length of the sidewall, a sidewall having a generally circular cross-sectional shape, in which the cross-sectional diameter varies at different positions along the axial length of the sidewall, etc.). In the embodiments shown in the FIGS., sidewall 16 is a substantially circular shaped sidewall having different diameters at different axial positions along the length of the sidewall. Referring in particular to FIG. 1A and FIG. 2, sidewall 16 includes a center section, shown as center portion 24, an upper sidewall section, shown as upper portion 26, and a lower sidewall section, shown as lower portion 28. Generally, center portion 24 is a centrally located portion of sidewall 16 in which the axial center point of the sidewall is located, upper portion 26 is a sidewall section extending from an upper end of center portion 24, and lower portion 28 is a sidewall section extending from a lower end of center portion 24.

In the embodiment shown, center portion 24 has a diameter D1, and in the embodiment shown, center portion 24 is a substantially cylindrical section such that D1 remains constant, for at least a portion of the axial length of center portion 24. Upper portion 26 extends upward from center portion 24 and extends radially outward relative to center portion 24, and lower portion 28 extends downward from center portion 24 and extends radially outward relative to center portion 24. Upper portion 26 includes a diameter D2, and lower portion 28 includes a diameter D3. As shown, both D2 and D3 are greater than D1. In this embodiment, upper portion 26 is outwardly angled and provides the transition from the small diameter of D1 to the greater diameter of D2, and lower portion 28 is outwardly angled and provides the transition from the small diameter of D1 to the greater diameter of D3. Thus, in this embodiment, the diameter of sidewall 16 increases from the upper end of center portion 24 to D2, and the diameter of sidewall 16 increases from the lower end of center portion 24 to D3. In other embodiments, D1 may be greater than D2 and/or D3 such that the sidewall portions immediately above and/or below center portion 24 angle radially inward relative to the center section. In another embodiment, D2 may be the same as D1 such that both upper portion 26 and center portion 24 have substantially the same diameter and shape as each other, and in this embodiment, D3 may be different from both D2 and D1 such that only lower portion 28 has a non-cylindrical shape. In another embodiment, D3 may be the same as D1 such that both lower portion 28 and center portion 24 have substantially the same diameter and shape as each other, and in this embodiment, D2 may be different from both D3 and D1 such that only upper portion 26 has a non-cylindrical shape.

As shown in FIG. 2, sidewall 16 is shown prior to the attachment of upper and lower can ends 12 and 14, and includes an upper flange 30 and a lower flange 32. Upper flange 30 is an outwardly curled section of metal contiguous with the rest of sidewall 16 and is configured to be interlocked and crimped with an outer peripheral section of upper can end 12 to form seam 20 (shown in FIG. 1A). Lower flange 32 is an outwardly curled section of metal contiguous with the rest of sidewall 16 and is configured to be interlocked and crimped with an outer peripheral section of lower can end 14 to form seam 22 (shown in FIG. 1A). Upper section 26 continues to extend radially outward beyond the portion labeled D2 to join to flange 30, and lower section 28 continues to extend radially outward beyond the portion labeled D3 to join to flange 32. In other embodiments, both upper section 26 and lower section 28 may curve radially inward to join to flanges 30 and 32, respectively.

In the embodiment shown, sidewall 16 is sized and shaped to be coupled to upper and lower can ends that have different diameters from each other. Sidewall 16 has an upper diameter D4 and lower diameter D5, and upper and lower diameters D4 and D5 are selected such that the final, sealed can 10 has end walls of two different sizes. In the embodiment shown, D4 is greater than D5 such that the diameter of lower end wall 14 is smaller than the diameter of upper end wall 12. In one embodiment, D4 is 2.88 inches plus or minus a half inch, and in another embodiment, D4 is 2.880 inches plus or minus 0.005 inches. In one embodiment, D5 is 2.76 inches plus or minus a half inch, and in another embodiment, D5 is 2.760 inches plus or minus 0.005 inches.

As shown in FIG. 2, the portion of upper sidewall section 26 extending from the upper end of center portion 24 to the location of D2 is a substantially straight segment (e.g., non-curved, annular, etc.), and the portion of lower sidewall section 28 extending from the lower end of center portion 24 to the location of D3 is a substantially straight segment (e.g., non-curved, annular, etc.). In other embodiments, upper sidewall section 26 and/or lower sidewall section 28 may include one or more curved sections. It should be understood, that the general shape and dimensions of sidewall 16 discussed herein refer to the shape and dimensions of the sidewall sections generally (e.g., if the shape and dimensions of the beads are ignored), and are not intended to relate to the localized shape and dimension variability introduced by the beads. For example, center portion 24 is generally cylindrical with a constant diameter if the localized variability of the beads in center portion 24 are ignored or averaged. The same applies to upper portion 26 and lower portion 28.

In various embodiments discussed herein, can 10 includes a series of beads that act to strength the non-cylindrical of the can against inwardly directed forces. In the various embodiments discussed herein, beads are formed in the non-cylindrical portions of the sidewall and act to strengthen the sidewall against inwardly directed forces. In the embodiment of FIG. 1A, can 10 includes a plurality of circumferential beads 40 formed in sidewall 16. Generally, each bead 40 is a radially outwardly extending curved surface that extends radially outward relative to sidewall 16. In various embodiments, can 10 includes at least two circumferential beads including at least one bead located in center portion 24 and at least one bead located in upper portion 26 and/or in lower portion 28. Beads 40 act to strengthen sidewall 16 against radial loads that may occur due to the internal vacuum in can 10 and/or by the grip of a person holding can 10. In various embodiments, can 10 is configured to hold contents at an internal vacuum of at least 28 pounds/square inch (gauge) or "psig," and in another embodiment, can 10 is configured to hold contents at an internal vacuum of at least 22 psig. In other embodiments, can 10 is filled with food located with the internal cavity of can 10 and the can is sealed and has an internal vacuum of at least 22 psig, in one embodiment, and at least 28 psig, in another embodiment. In these embodiments, beads 40 are configured to strength non-cylindrical sidewall 16 against the radial inward force that results from the internal vacuum.

In various embodiments, sidewall 16 is made from metal of various thicknesses, and beads 40 are selected to strength non-cylindrical sidewall 16 against the radial inward force that results from the internal vacuum for the various thicknesses. According to various exemplary embodiments, sidewall 16 is formed from steel (e.g., tinplate, stainless steel, food grade tinplate, etc.) having a working gauge range of about 0.003 inches thick to about 0.012 inches thick, specifically of about 0.005 inches thick to about 0.009 inches thick, and more specifically, of about 0.0065 inches thick to about 0.0080 inches thick. In various embodiments, sidewall 16 is formed from steel having a thickness between 0.00684 inches thick and 0.00756 inches thick, specifically between about 0.00698 inches thick and 0.00756 inches thick, and more specifically is about 0.072 inches thick.

In various embodiments, for example as shown in FIGS. 1A and 2, can 10 includes a bead panel 42. Bead panel 42 includes a plurality of continuous, radially outwardly extending beads 40. In various embodiments, bead panel 42 is formed in the material of center portion 24, upper portion 26 and lower portion 28, such that bead panel 42 is a continuous beaded sidewall section extending from the non-cylindrical upper portion 26 through cylindrical center portion 24 and into non-cylindrical lower portion 28. Thus, bead panel 42 includes beads 40 located on the cylindrical portion (e.g., center portion 24) and on the non-cylindrical or angled portions (e.g., upper portion 26 and lower portion 28) of sidewall 16.

Figure 3:
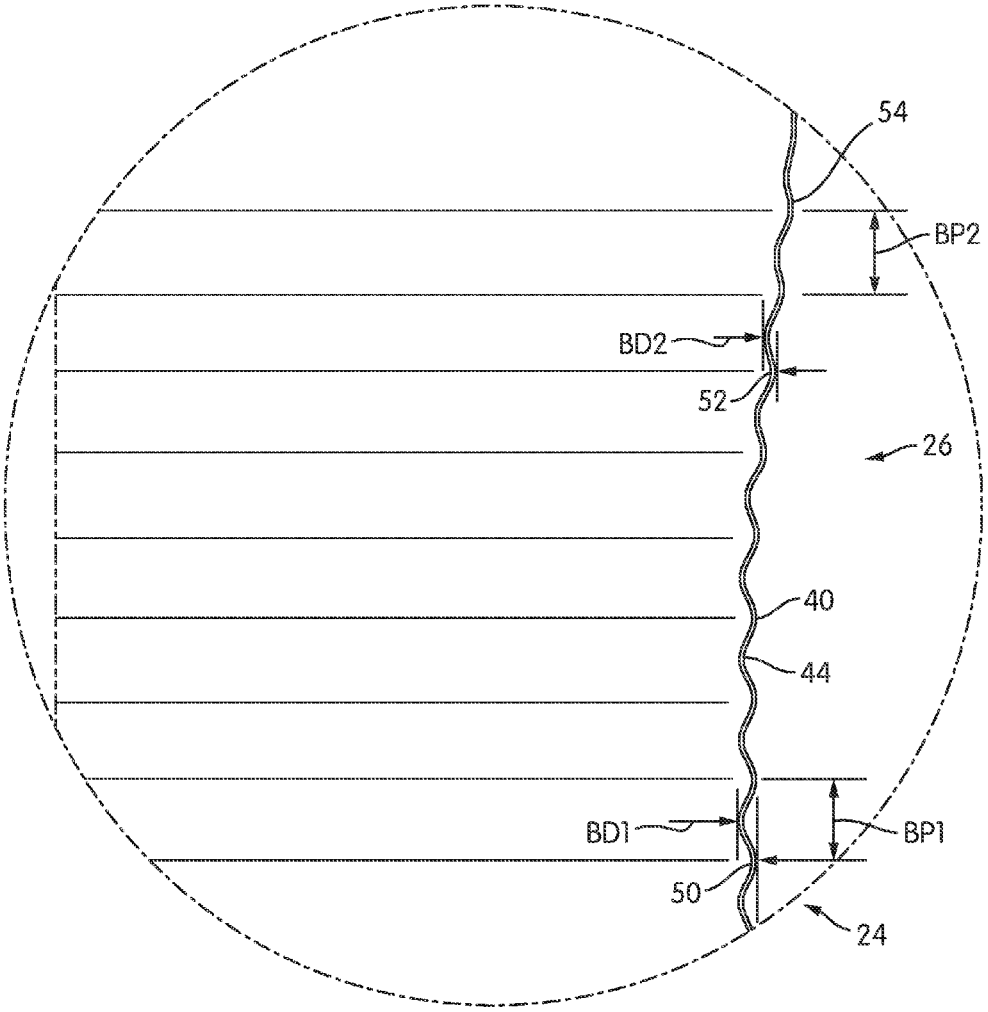
FIG. 3 is an enlarged view of a portion of the container shown in FIG. 2.

Referring to FIG. 3, a detailed view of center portion 24 and upper portion 26 of sidewall 16 is shown. As shown in FIG. 3, a radially inwardly extending curved bead 44 is located between each adjacent outwardly extending bead 40 in bead panel 42. This configuration gives bead panel 42 a pattern of alternating outwardly extending beads 40 and inwardly extending surfaces, and in this embodiment, each outwardly extending bead 40 is contiguous with each adjacent inwardly extending bead 44. In the embodiment shown, the outer surface of each bead 40 is a continuously curved surface that is concave relative to the longitudinal axis 34 of can 10, and the outer surface of each inward bead 44 is a continuously curved surface that is convex relative to longitudinal axis 34. As shown in FIG. 1A, each inwardly extending curved bead 44 extends around the circumference of sidewall 16.

In various embodiments, the shape (e.g., the depth, height, radius of curvature, the profile outline, etc.) of circumferential beads 40 varies at different axial positions along sidewall 16. In one embodiment as shown in FIG. 2, the shape of at least one bead 40 located in upper sidewall portion 26 is different from the shape of at least one bead located in center portion 24, and the shape of at least one bead 40 located in lower sidewall portion 28 is different from the shape of at least one bead located in center portion 24. In various embodiments, the shape of beads 40 is a function of the diameter of sidewall 16 in which the beads are located. For example, in the embodiment shown in FIGS. 2 and 3, the shape of beads 40 is a function of the diameter of sidewall 16 at the location of the bead.

In various embodiments, the depth of each bead 40 (e.g., distance between the outermost point of an outward bead 40 and the inner most surface of the adjacent inwardly curved bead 44 measured in the direction perpendicular to longitudinal axis 34) is a function of the diameter of sidewall 16 in which the bead 40 is formed. Thus, in the embodiment shown in FIG. 2, the depth of beads 40 located in upper sidewall portion 26 is different than the depth of the beads 40 located in center sidewall portion 24, and the depth of beads 40 located in lower sidewall portion 28 is different than the depth of the beads 40 located in center sidewall portion 24. In general as shown in FIG. 2, the depth of at least one bead 40 in upper sidewall portion 26 is less than the depth of at least one bead 40 formed in center portion 24, and the depth of at least one bead 40 in lower sidewall portion 28 is less than the depth of at least one bead 40 formed in center portion 24.

In the embodiment shown in FIG. 2, both upper portion 26 and lower portion 28 are tapered sections having diameters that increase as the distance from the axial center point of can 10 increases. In this embodiment, the depth of beads 40 in both upper portion 26 and lower portion 28 decrease as the axial distance from the center point increases. Further, the depth of beads 40 in both upper portion 26 and lower portion 28 decrease as the axial distance to upper end wall 12 and lower end wall 14 decreases, respectively. In these embodiments, the depth of beads 40 decrease as the diameter of sidewall 16 at the location of the bead increases.

In various embodiments, the pitch of each bead 40 (e.g., the distance between the outer most points of adjacent outward beads measured in the direction parallel to longitudinal axis 34) is a function of the diameter of sidewall 16 in which the bead 40 is formed. Thus, in the embodiment shown in FIG. 2, the pitch of beads 40 located in upper sidewall portion 26 is different than the pitch of the beads 40 located in center sidewall portion 24, and the pitch of beads 40 located in lower sidewall portion 28 is different than the pitch of the beads 40 located in center sidewall portion 24.

Referring to FIG. 3, an enlarged view of center portion 24 and upper portion 26 is shown according to an exemplary embodiment. By way of example, outward bead 50 is a bead located in center portion 24 and outward bead 52 is a bead located in upper portion 26. Bead 50 has a bead depth BD1, and bead 52 has a bead depth BD2. In one embodiment, depth BD1 of bead 50 is the same before and after sidewall 16 is shaped into the non-cylindrical shape shown in FIG. 2, and depth BD2 of bead 52 is less than the depth of bead 52 before shaping.

FIG. 3 shows a portion of a non-cylindrical sidewall in which the shape of the bead 40 varies based upon the diameter of the sidewall 16 at the location of the bead 40 according to an exemplary embodiment. In various embodiments, BD2 is between 1% and 40% less than BD1, specifically between 5% and 30% less than BD1 and more specifically is between 5% less and 20% less than BD1. In specific embodiments, BD2 is between 10% and 20% less than BD1 and more specifically is between 13% and 16% of BD1.

In various embodiments, BD1 is between 0.015 and 0.035 inches, specifically between 0.020 and 0.030 inches and more specifically is between 0.023 and 0.027 inches. In various embodiments, BD2 is between 0.011 and 0.031 inches, specifically is between 0.016 and 0.026 inches and more specifically is between 0.019 and 0.023 inches.

In various embodiments, BD2 of bead 52 is different before and after shaping a metal tube into a non-cylindrical sidewall 16. For example, in various embodiments, before shaping of upper portion 26 into the non-cylindrical shape, BD2 is between 0.015 and 0.035 inches, specifically between 0.020 and 0.030 inches and more specifically is between 0.023 and 0.027 inches, and, in these embodiments, after shaping, BD2 is between 0.011 and 0.031 inches, specifically is between 0.016 and 0.026 inches and more specifically is between 0.019 and 0.023 inches.

As noted above, bead pitch also varies based on the diameter of the sidewall 16 where the beads are located. By way of example, bead panel 42 includes an upper most outward bead 54 located in upper portion 26 at the uppermost end of bead panel 42. Bead 50 has a bead pitch BP1, and bead 54 has a bead pitch BP2. In one embodiment, bead pitch BP1 of bead 50 is the same before and after sidewall 16 is shaped into the non-cylindrical shape shown in FIG. 2, and pitch BP2 of bead 54 is greater than the pitch of bead 54 before shaping. In various embodiments, BP2 is between 0.5% and 15% greater than BP1, specifically between 0.5% and 10% greater than BP1 and more specifically is between 1% and 5% greater than BP1. For the specific embodiment shown in FIG. 3, BP2 is about 3.5% greater than BP1 (plus or minus 0.5%).

In various embodiments, BP1 is between 0.05 and 0.25 inches, specifically between 0.09 and 0.20 inches and more specifically is between 0.12 and 0.16 inches. In one specific embodiment, BP1 is between 0.139 and 0.140 inches and more specifically is about 0.1396 inches. In various embodiments, BP2 is between 0.05 and 0.25 inches, specifically between 0.09 and 0.20 inches and more specifically is between 0.12 and 0.16 inches. In one specific embodiment, BP2 is between 0.140 and 0.141 inches and more specifically is about 0.1445 inches. In various embodiments, BP2 is between 0.139 and 0.140 inches prior to shaping of upper portion 26 into the non-cylindrical shape, and BP2 is between 0.140 and 0.0141 inches after shaping of upper portion 26 into the non-cylindrical shape. It should be noted that corresponding beads in lower portion 28 may be similarly shaped as beads 52 and 54 and the measurements, relative sizing and ratios discussed herein also relate to beads in lower portion 28.

Figure 4:
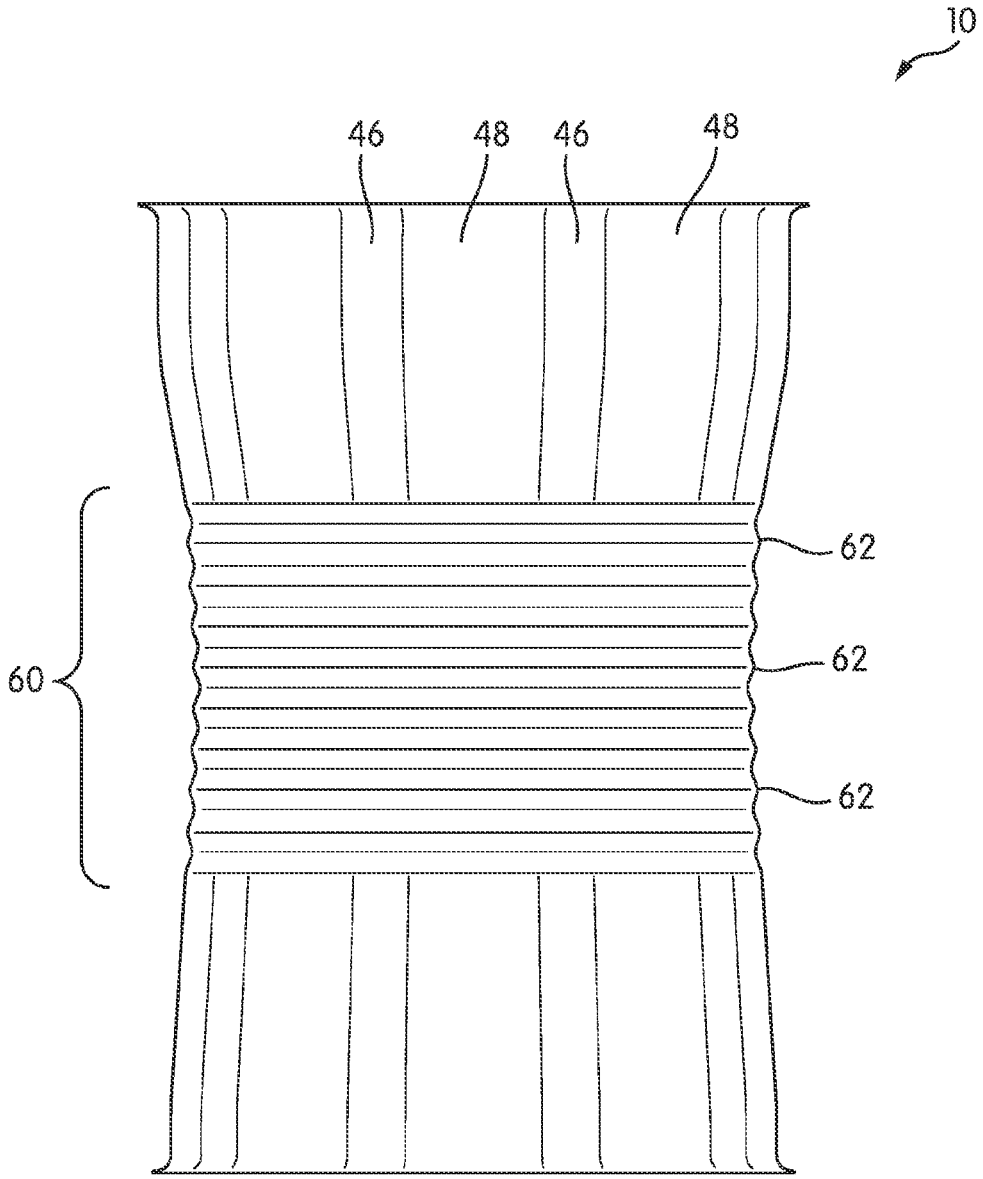
FIG. 4 is a front elevation view of a container according to another exemplary embodiment.
Figure 5:
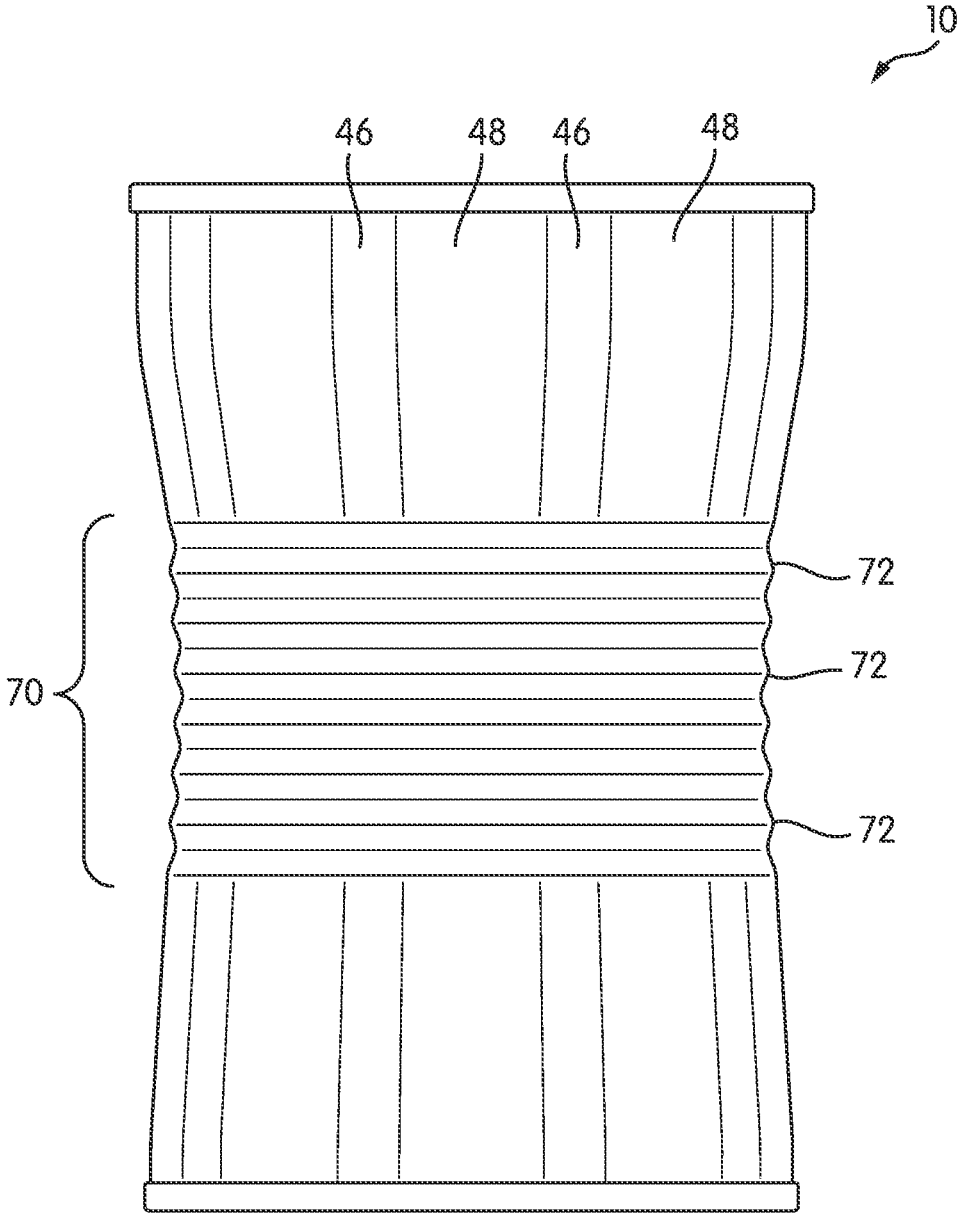
FIG. 5 is a front elevation view of a container according to another exemplary embodiment.

Referring to FIG. 2, in one embodiment, can 10 includes a bead panel 42 including 18 outwardly extending beads 40. Further, bead panel 42 extends more than 50% of the axial length of sidewall 16. However, in other embodiments, can 10 may include differently shaped bead panels. For example, as shown in FIG. 4, can 10 includes a bead panel 60 that includes eight radially outward extending beads 62, and, as shown in FIG. 5, can 10 includes a bead panel 70 that includes six radially outward extending beads 72. In various embodiments, the bead panel of can 10 may include between 4 and 24 beads, between 6 and 18 beads or between 8 and 18 beads.

Thus in the various embodiments, can 10 may include one or more outwardly extending beads on upper portion 26, one or more outwardly extending beads on center portion 24 and one or more outwardly extending beads on lower portion 28. In some embodiments, can 10 may include an unbeaded sidewall section between the beads of upper portion 26 and center portion 24, and can 10 may include an unbeaded sidewall section between the beads of lower portion 28 and center portion 24. In various embodiments, can 10 may include a bead panel that extends more than 25% of the axial length of sidewall 16, and in other embodiments, can 10 may include a bead panel that extends more than 30% of the axial length of sidewall 16. In various embodiments, can 10 may include a bead panel that accounts for between 25% to 75% of the axial length of sidewall 16, and in other embodiments, can 10 may include a bead panel that accounts for between 30% to 60% of the axial length of sidewall 16.

Referring back to FIG. 1A, sidewall 16 of can 10 includes an alternating series of vertically positioned bands or facets. As shown, for example in FIG. 1A, can 10 includes inwardly curved facets 46 spaced between outwardly curved facets 48. Inwardly curved facets 46 and outwardly curved facets 48 are evenly spaced around sidewall 16 and extend substantially parallel to the vertical axis of can 10. In one embodiment, can 10 includes ten inwardly curved facets 46 and nine outwardly curved facets 48. In one embodiment, facets 46 and facets 48 are caused by an expanding mandrel which expands within sidewall 16 to form the noncylindrical shape of sidewall 16.

Figure 6:
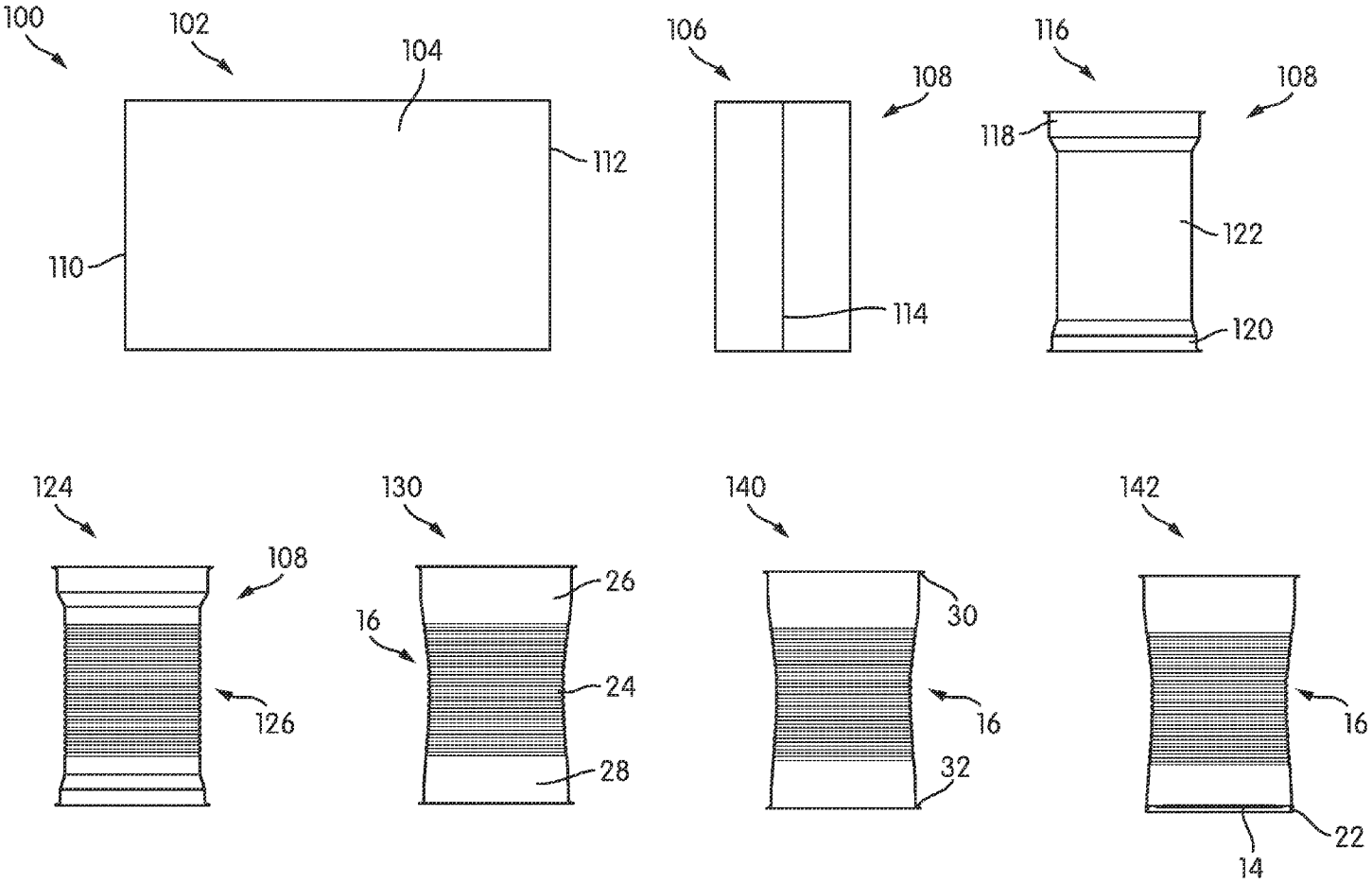
FIG. 6 shows a method of making a container according to an exemplary embodiment.

Referring to FIG. 6, a method 100 of making can 10 is shown according to an exemplary embodiment. At step 102, a rectangular piece of metal 104 is provided. At step 106, a metal tube 108 is provided. In one embodiment, tube 108 is formed by rolling rectangular piece of metal 104 such that the lateral edges 110 and 112 are adjacent to each other and are welded together creating a welded seam 114 that extends vertically the axial length of tube 108. At step 116, tube 108 under goes a pre-shaping step in which an upper flared section 118 and a lower flared section 120 are formed such that tube 108 includes a substantially cylindrical sidewall 122 located between the upper and lower flared sections.

At step 124, beads 126 are formed in the cylindrical sidewall 122. In one embodiment, beads 126 are formed such that each bead has substantially the same bead depth and bead pitch as the other beads formed in cylindrical sidewall 122. At step 130, tube 108 is shaped to form non-cylindrical sidewall 16 including center portion 24, upper portion 26 and lower portion 28, discussed above. Thus, the shaping step that forms the non-cylindrical sidewall 16 occurs after beads 126 are formed into the material that becomes sidewall 16.

Figure 7:
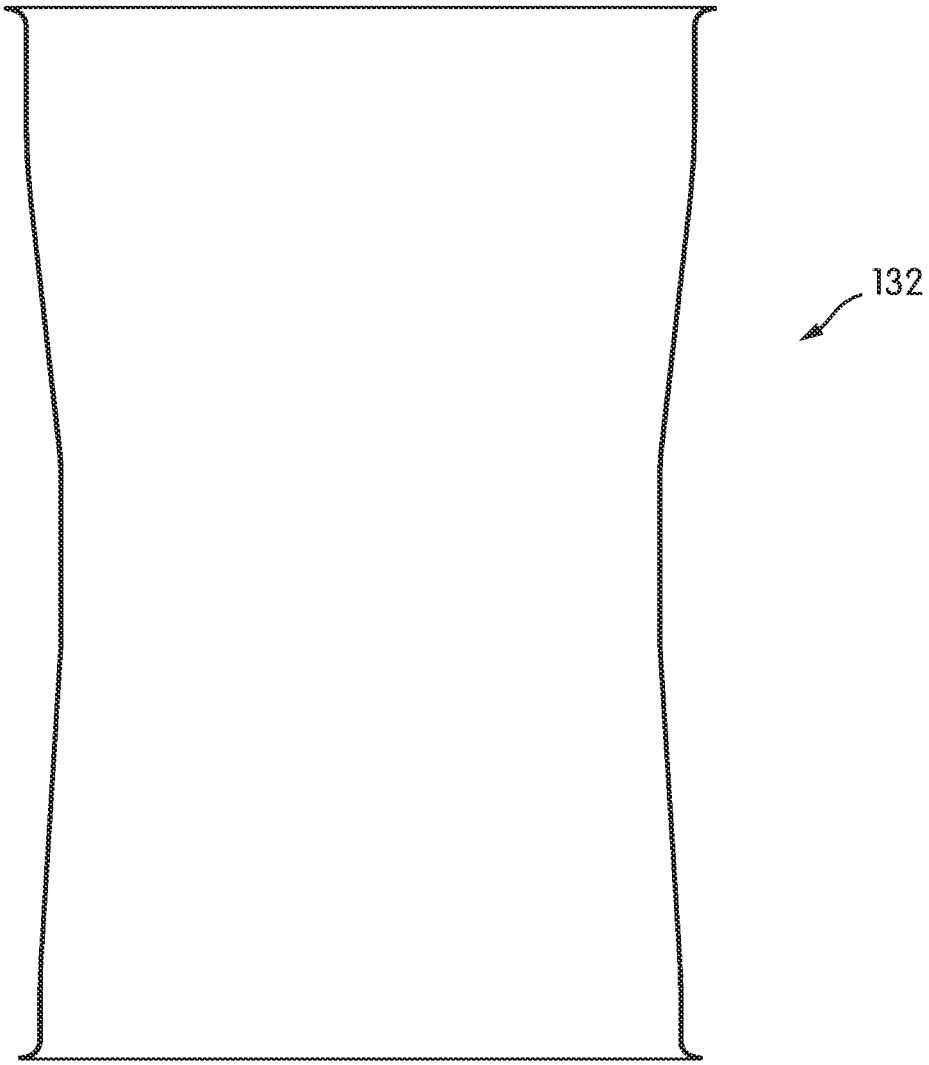
FIG. 7 is an expanding mandrel that may be used during the manufacture of a container according to an exemplary embodiment.

In one embodiment, non-cylindrical sidewall 16 is formed using an expanding mandrel 132, the shaped profile of which is shown in FIG. 7. Expanding mandrel 132 is shown in the expanded configuration in FIG. 7, and the expanded configuration is shaped to match the desired shape of non-cylindrical sidewall 16. To shape the sidewall using mandrel 132, mandrel 132 in the unexpanded stated is inserted into tube 108 shown at step 124. Following insertion into tube 108, mandrel 132 expands to the configuration shown in FIG. 7 and in doing so, pushes tube 108 outward forming non-cylindrical sidewall 16.

Figure 8:
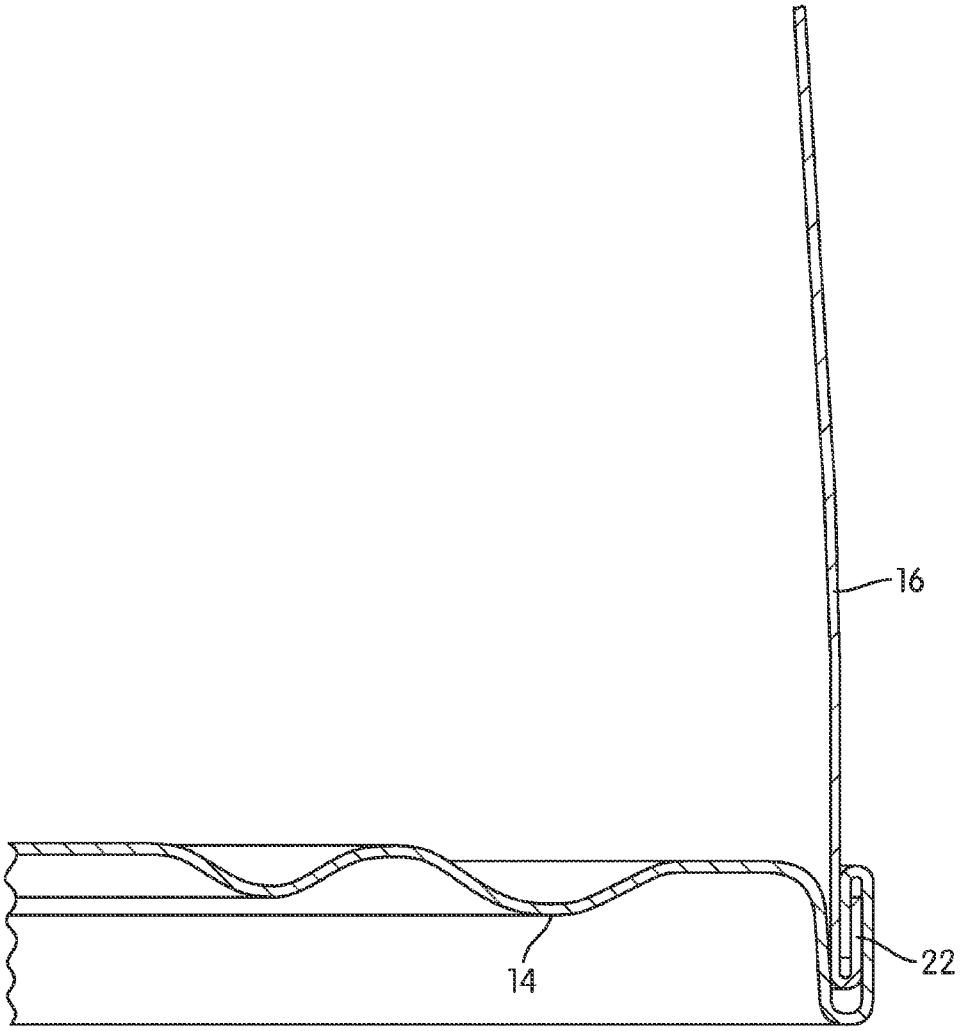
FIG. 8 is a detailed sectional view showing an end wall attached to a sidewall via double seam according to an exemplary embodiment.

At step 140, upper flange 30 and lower flange 32 are formed at the upper and lower ends of sidewall 16. At step 142, lower end wall 14 is coupled to the lower flange 32 via double seam 22. A detailed view of double seam 22 is shown in FIG. 8 and shows the seam formed from interlocked and crimped portions of material of both sidewall 16 and end wall 14. Following attachment of lower end wall 14, can 10 may be stored or shipped along with a separate upper can end 12. Once can 10 is filled, for example filled with food at a packaging facility, upper end wall 12 is attached to sidewall 16 via double seam 22 hermetically sealing the food within can 10.

Figure 9:
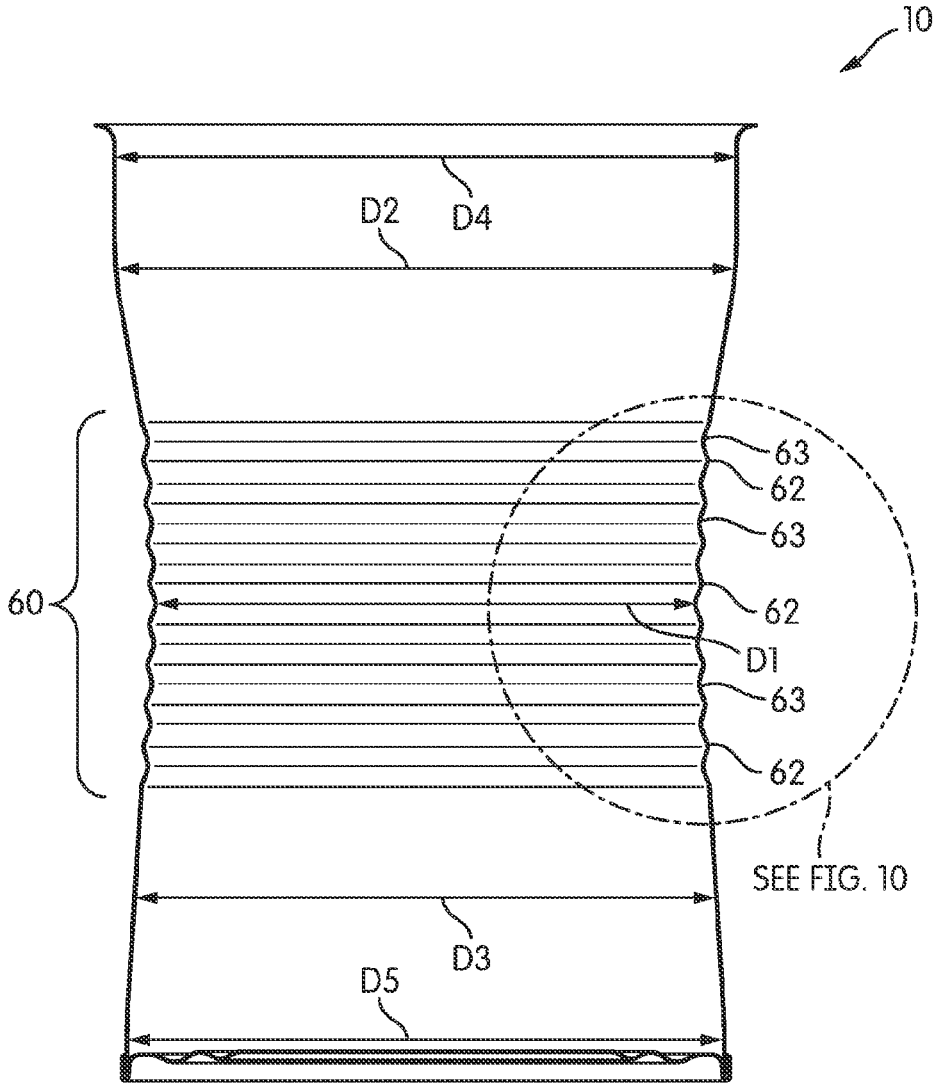
FIG. 9 is a sectional view taken along the longitudinal axis of the container of FIG. 4 according to an exemplary embodiment.
Figure 10:
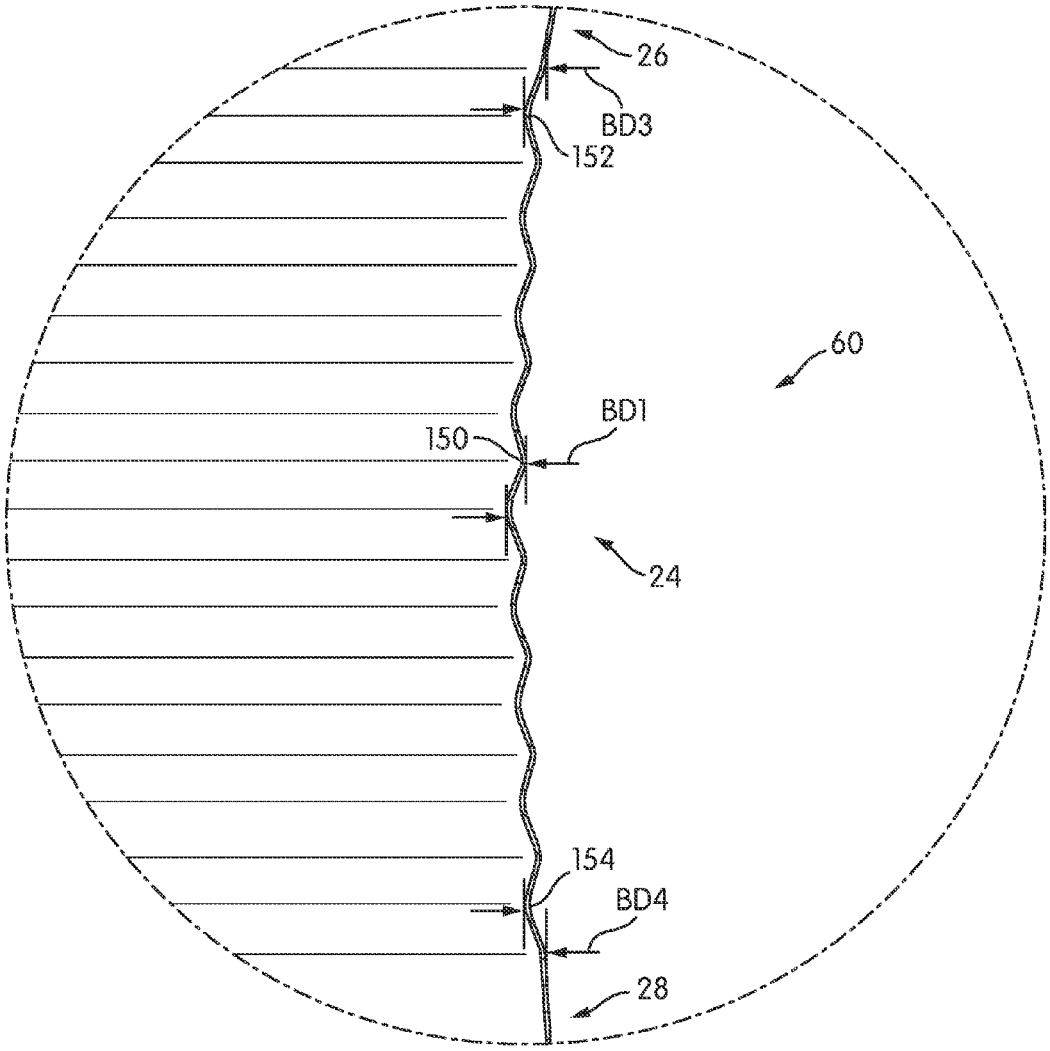
FIG. 10 is an enlarged view of a portion of the container shown in FIG. 9.

Referring to FIG. 9, a cross-sectional view of can 10, having bead panel 60 as shown in FIG. 4, is depicted according to an exemplary embodiment. FIG. 10 shows an enlarged view of bead panel 60. As shown in FIG. 9 and FIG. 10, bead panel 60 includes eight radially outwardly curved beads 62 and nine radially inwardly curved beads 63. Similar to the embodiment discussed above regarding FIG. 2, beads 62 and beads 63 extend through the center portion of the can sidewall onto the expanded upper and lower sidewall portions, and the shape, bead height and/or bead depth of beads 62 and beads 63 may vary based on the diameter of the sidewall at the location of the bead, providing increased strength to the can sidewall.

Referring to FIG. 10, bead 150 is a centrally located bead located in center sidewall portion 24 and has a bead depth BD1 as discussed above. Bead 152 is an inwardly curved bead formed in upper sidewall portion 26, and bead 154 is an inwardly curved bead formed in lower sidewall portion 28. Bead 152 has a bead depth BD3, which is the radial distance measured between the radially innermost point of bead 152 and the upper edge of bead panel 60. Bead 154 has a bead depth BD4, which is the radial distance measured between the radially innermost point of bead 154 and the lower edge of bead panel 60.

In various embodiments, BD3 is between 10% and 60% less than BD1, specifically between 20% and 50% less than BD1 and more specifically is between 25% less and 40% less than BD1. In specific embodiments, BD3 is between 30% and 40% less than BD1 and more specifically is between 30% and 36% less than BD1.

In various embodiments, BD1 is between 0.015 and 0.035 inches, specifically between 0.020 and 0.030 inches and more specifically is between 0.023 and 0.027 inches. In various embodiments, BD3 is between 0.006 and 0.031 inches, specifically is between 0.010 and 0.020 inches and more specifically is between 0.013 and 0.019 inches. In a specific embodiment, BD3 is about 0.016 inches.

In various embodiments, BD3 of bead 152 is different before and after shaping a metal tube into a non-cylindrical sidewall 16. For example, in various embodiments, before shaping of upper portion 26 into the non-cylindrical shape, BD3 is between 0.015 and 0.035 inches, specifically between 0.020 and 0.030 inches and more specifically is between 0.023 and 0.027 inches, and, in these embodiments, after shaping, BD3 is between 0.006 and 0.031 inches, specifically is between 0.010 and 0.020 inches and more specifically is between 0.013 and 0.019 inches. In a specific embodiment, BD3 is about 0.016 inches after shaping.

In various embodiments, BD4 is between 20% and 70% less than BD1, specifically between 30% and 60% less than BD1 and more specifically is between 35% and 55% less than BD1. In specific embodiments, BD3 is between 40% and 50% less than BD1 and more specifically is between 43% and 46% less than BD1. In various embodiments, BD4 is between 0.003 and 0.023 inches, specifically is between 0.07 and 0.019 inches and more specifically is between 0.010 and 0.016 inches. In a specific embodiment, BD4 is about 0.013 inches.

In various embodiments, BD4 of bead 154 is different before and after shaping a metal tube into a non-cylindrical sidewall 16. For example, in various embodiments, before shaping of lower portion 28 into the non-cylindrical shape, BD4 is between 0.015 and 0.035 inches, specifically between 0.020 and 0.030 inches and more specifically is between 0.023 and 0.027 inches, and, in these embodiments, after shaping, BD4 is between 0.003 and 0.023 inches, specifically is between 0.07 and 0.019 inches and more specifically is between 0.010 and 0.016 inches. In a specific embodiment, BD4 is about 0.013 inches, after shaping.

As shown in FIG. 9, bead panel 60 extends at least 20% but less than 80% of the axial length of the sidewall of can 10. In one embodiment, bead panel 60 accounts between 30% and 40% of the axial length of the sidewall of can 10, and more specifically accounts for about 37% of the axial length of the sidewall of can 10. As noted above, bead panel 60 extends through center portion 24 and onto the expanded upper and lower sections of the can sidewall.

The containers discussed herein may be formed from any material, including metals, plastics, ceramics and glasses in various exemplary embodiments. According to an exemplary embodiment, the containers discussed herein are formed from metal, such as tin-coated steel or aluminum. In some embodiments, the containers discussed herein are formed from aluminum and the can ends are formed from tin-coated steel. In other embodiments, other metals or materials (e.g., polymers, high-temperature plastic, thermoplastics, cardboard, ceramic, etc.) are used to form some or all of the container.

Containers discussed herein may include containers of any style, shape, size, etc. For example, the containers discussed herein may be shaped such that cross-sections taken perpendicular to the longitudinal axis of the container are generally circular. However, in other embodiments the sidewall of the containers discussed herein may be shaped in a variety of ways (e.g., having other non-polygonal cross-sections, as a rectangular prism, a polygonal prism, any number of irregular shapes, etc.) as may be desirable for different applications or aesthetic reasons. In various embodiments, the sidewall of can 10 may include one or more axially extending sidewall sections that are curved radially inwardly or outwardly such that the diameter of the can is different at different places along the axial length of the can, and such curved sections may be smooth continuous curved sections. In one embodiment, can 10 may be hourglass shaped. Can 10 may be of various sizes (e.g., 3 oz., 8 oz., 12 oz., 15 oz., 28 oz, etc.) as desired for a particular application.

Further, a container may include a container end (e.g., a closure, lid, cap, cover, top, end, can end, sanitary end, "pop-top", "pull top", convenience end, convenience lid, pull-off end, easy open end, "EZO" end, etc.). The container end may be any element that allows the container to be sealed such that the container is capable of maintaining a hermetic seal. In an exemplary embodiment, the upper can end may be an "EZO" convenience end, sold under the trademark "Quick Top" by Silgan Containers Corp.

The upper and lower can ends discussed above are shown coupled to the can body via a "double seam" formed from the interlocked portions of material of the can sidewall and the can end. However, in other embodiments, the can ends discussed herein may be coupled to the sidewall via other mechanisms. For example, can ends may be coupled to the sidewall via welds or solders. As shown above, the containers discussed herein are three-piece cans having an upper can end, a lower can end and a sidewall each formed from a separate piece of material. However, in other embodiments, a two-piece can (i.e., a can including a sidewall and an end wall that are integrally formed and a separate can end component joined to the sidewall via a double seam) may be provided with an internal strainer as discussed herein.

In various embodiments, the upper can end may be a closure or lid attached to the body sidewall mechanically (e.g., snap on/off closures, twist on/off closures, tamper-proof closures, snap on/twist off closures, etc.). In another embodiment, the upper can end may be coupled to the container body via an internal vacuum. The container end may be made of metals, such as steel or aluminum, metal foil, plastics, composites, or combinations of these materials. In various embodiments, the can ends, double seams, and sidewall of the container are adapted to maintain a hermetic seal after the container is filled and sealed.

The containers discussed herein may be used to hold perishable materials (e.g., food, drink, pet food, milk-based products, etc.). It should be understood that the phrase "food" used to describe various embodiments of this disclosure may refer to dry food, moist food, powder, liquid, or any other drinkable or edible material, regardless of nutritional value. In other embodiments, the containers discussed herein may be used to hold non-perishable materials or non-food materials. In various embodiments, the containers discussed herein may contain a product that is packed in liquid that is drained from the product prior to use. For example, the containers discussed herein may contain vegetables, pasta or meats packed in a liquid such as water, brine, or oil.

During certain processes, containers are filled with hot, pre-cooked food then sealed for later consumption, commonly referred to as a "hot fill process." As the contents of the container cool, a vacuum develops inside the container. In embodiments using a vacuum attached closure, the resulting vacuum may partially or completely secure the closure to the body of the container. During other processes, containers are filled with uncooked food and are then sealed. The food is then cooked to the point of being commercially sterilized or "shelf stable" while in the sealed container. During such a process, the required heat and pressure may be delivered by a pressurized heating device or retort.

According to various exemplary embodiments, the inner surfaces of the upper and lower can ends and the sidewall may include a liner (e.g., an insert, coating, lining, a protective coating, sealant, etc.). The protective coating acts to protect the material of the container from degradation that may be caused by the contents of the container. In an exemplary embodiment, the protective coating may be a coating that may be applied via spraying or any other suitable method. Different coatings may be provided for different food applications. For example, the liner or coating may be selected to protect the material of the container from acidic contents, such as carbonated beverages, tomatoes, tomato pastes/sauces, etc. The coating material may be a vinyl, polyester, epoxy, EVOH and/or other suitable lining material or spray. The interior surfaces of the container ends may also be coated with a protective coating as described above.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A metal can for holding and storing food comprising:

a container end;

a non-cylindrical metal sidewall comprising:

a center section having a first diameter;

an upper sidewall section located above the center section having a second diameter different than the first diameter, the upper sidewall section extending radially relative to the center section to provide a transition from the first diameter to the second diameter;

a lower sidewall section located below the center section having a third diameter different than the first diameter, the lower sidewall section extending radially relative to the center section to provide a transition from the first diameter to the third diameter wherein the first diameter is less than the second diameter and the third diameter;

a plurality of circumferential beads formed in the metal sidewall, wherein a circumferential bead is formed in each of the center section, the upper sidewall section and the lower sidewall section;

wherein each of the plurality of circumferential beads has a maximum bead depth as measured between a radially outermost point of the bead and a radially innermost point of the bead, wherein the maximum depth of the circumferential bead formed in the upper sidewall section is less than the maximum depth of the circumferential bead formed in the center section and the maximum depth of the circumferential bead formed in the lower sidewall section is less than the maximum depth of the circumferential bead formed in the center section.

2. The metal can of claim 1 wherein each of the circumferential beads has a shape and the shape of the circumferential bead formed in the upper sidewall section is different from the shape of the circumferential bead formed in the center section and the shape of the circumferential bead formed in the lower sidewall section is different from the shape of the circumferential bead formed in the center section.

3. The metal can of claim 1 wherein the upper sidewall section extends radially outward relative to the center section providing the transition from the first diameter to the second diameter and the lower sidewall section extends radially outward relative to the center section providing the transition from the first diameter to third diameter.

4. The metal can of claim 1 wherein the maximum bead depths of the circumferential beads decrease as the diameter of the sidewall in which the bead is formed increases.

5. The metal can of claim 1 wherein the maximum depth of the circumferential bead in the upper sidewall section is less than the maximum depth of any bead in the center section.

6. The metal can of claim 1 further comprising a second container end coupled to a lower edge of the sidewall via a first seam formed from interlocked portions of the sidewall and the second container end, wherein the first container end is coupled to an upper edge of the sidewall via a second seam formed from interlocked portions of the sidewall and the first container end, wherein the container has an internal vacuum such that there is a pressure differential between the interior of the container and atmospheric pressure after filling and sealing, wherein the plurality of circumferential beads strengthen the sidewall against the inwardly directed force that results from the internal vacuum, and further wherein the sidewall is made from metal having a thickness between 0.006 inches and 0.012 inches.

7. The metal can of claim 1 wherein the metal is steel.

8. The metal can of claim 1 wherein the plurality of circumferential beads is a bead panel comprising a continuous series of radially outward extending curved surfaces and radially inward extending curved surfaces positioned between each radially outward extending curved surface, each radially outward extending curved surface and each radially inward extending curved surface extending circumferentially around the metal sidewall.

9. The metal can of claim 8 wherein the bead panel encompasses between 25% and 75% of the axial length of the sidewall.

10. The metal can of claim 8 wherein the bead panel extends continuously through the upper sidewall section, the center section and the lower sidewall section, wherein the maximum depth of each circumferential bead of the bead panel is a maximum radial distance measured from a radially outermost point of each outward extending curved surface to a radially innermost surface of the adjacent radially inward extending curved surface.

11. The metal can of claim 10 wherein the maximum depth of each of the circumferential beads of the bead panel decrease as the radial distance between the circumferential bead and a longitudinal axis of the can increases.

12. The metal can of claim 1 wherein the maximum depth of each circumferential bead decrease as the radial distance between the circumferential bead and a longitudinal axis of the can increases.

13. A metal can for holding and storing food comprising:

a container end;

a non-cylindrical metal sidewall comprising:

a center section having a first diameter;

an upper sidewall section located above the center section having a second diameter different than the first diameter, the upper sidewall section extending radially relative to the center section to provide a transition from the first diameter to the second diameter;

a lower sidewall section located below the center section having a third diameter different than the first diameter, the lower sidewall section extending radially relative to the center section to provide a transition from the first diameter to the third diameter;

a bead panel comprising a plurality of circumferential beads formed from a continuous series of radially outwardly extending curved surfaces and radially inwardly extending curved surfaces positioned between each radially outwardly extending curved surface, each radially outwardly extending curved surface and each radially inwardly extending curved surface extending circumferentially around the metal sidewall, wherein the bead panel is formed in the metal sidewall and extends continuously through the upper sidewall section, center section and the lower sidewall section;

wherein a maximum radial depth of each bead of bead panel, as measured between a radially outermost point of the radially outwardly extending surface of the bead and a radially innermost surface of the adjacent radially inwardly extending curved surface of the bead, decrease as the radial distance between the bead panel and a longitudinal axis of the can increases;

wherein first diameter is less than the second diameter and the third diameter.

14. The metal can of claim 13 wherein the bead panel encompasses between 25% and 75% of the axial length of the sidewall.

* * * * *